US012221713B2

(12) United States Patent
Bay et al.

(10) Patent No.: US 12,221,713 B2
(45) Date of Patent: Feb. 11, 2025

(54) FLOW GENERATOR, DEPOSITION DEVICE AND METHOD FOR THE DEPOSITION OF A MATERIAL

(71) Applicant: RENA Technologies GmbH, Guetenbach (DE)

(72) Inventors: Norbert Bay, Guetenbach (DE); Konrad Kaltenbach, Guetenbach (DE)

(73) Assignee: RENA Technologies GmbH, Guetenbach (DE)

( * ) Notice: Subject to any disclaimer, the term of this patent is extended or adjusted under 35 U.S.C. 154(b) by 0 days.

(21) Appl. No.: 17/265,002

(22) PCT Filed: Jul. 30, 2019

(86) PCT No.: PCT/DE2019/100699
§ 371 (c)(1),
(2) Date: Feb. 1, 2021

(87) PCT Pub. No.: WO2020/025090
PCT Pub. Date: Feb. 6, 2020

(65) Prior Publication Data

US 2021/0324535 A1 Oct. 21, 2021

(30) Foreign Application Priority Data

Jul. 30, 2018 (DE) ..... 10 2018 118 410.7

(51) Int. Cl.

| | |
|---|---|
| ***C25D 17/06*** | (2006.01) |
| ***C25D 5/08*** | (2006.01) |
| ***C25D 17/00*** | (2006.01) |
| ***C25D 21/10*** | (2006.01) |

(52) U.S. Cl.
CPC ..... *C25D 21/10* (2013.01); *C25D 5/08* (2013.01); *C25D 17/005* (2013.01); *C25D 17/06* (2013.01)

(58) Field of Classification Search
None
See application file for complete search history.

(56) References Cited

U.S. PATENT DOCUMENTS 3,929,592 A * 12/1975 Klingenmaier ..... C25D 7/04 205/122
4,304,641 A 12/1981 Grandia et al.
4,378,281 A 3/1983 Scanlon et al.
5,514,258 A 5/1996 Brinket et al.
(Continued)

FOREIGN PATENT DOCUMENTS

CN 203034114 U 7/2013
CN 203034115 U 7/2013
(Continued)

OTHER PUBLICATIONS

English translation WO 02079548. (Year: 2002).*
(Continued)

*Primary Examiner* — Stefanie S Wittenberg
(74) *Attorney, Agent, or Firm* — Laurence A. Greenberg; Werner H. Stemer; Ralph E. Locher

(57) ABSTRACT

A flow generator has an electrolyte feed device for feeding an electrolyte and an electrolyte distribution device. There is also described a deposition device having such a flow generator and a method for the deposition of a material on a surface of an object.

17 Claims, 4 Drawing Sheets

(56) References Cited

U.S. PATENT DOCUMENTS

| | | | | |
|---|---|---|---|---|
| 6,136,163 | A | 10/2000 | Cheung et al. | |
| 6,309,524 | B1 | 10/2001 | Woodruff et al. | |
| 6,540,899 | B2 | 4/2003 | Keigler | |
| 8,252,167 | B2 | 8/2012 | Kuriyama et al. | |
| 9,518,334 | B2 * | 12/2016 | Kao | C25D 17/001 |
| 9,657,406 | B2 | 5/2017 | Asa et al. | |
| 2002/0179450 | A1 * | 12/2002 | Barrese | C25D 21/12 205/96 |
| 2004/0140203 | A1 * | 7/2004 | Burkhart | C25D 7/123 204/297.01 |
| 2009/0272644 | A1 | 11/2009 | Lukkarila et al. | |
| 2014/0251798 | A1 | 9/2014 | Yoshioka et al. | |
| 2015/0129418 | A1 * | 5/2015 | Keigler | C25D 21/10 204/237 |
| 2015/0276835 | A1 * | 10/2015 | Minami | C25D 21/12 702/65 |
| 2016/0122889 | A1 | 5/2016 | Muhr et al. | |
| 2016/0319456 | A1 * | 11/2016 | Yoshioka | C25D 17/005 |
| 2017/0275776 | A1 * | 9/2017 | Wilson | H01L 21/2885 |

FOREIGN PATENT DOCUMENTS

| | | | |
|---|---|---|---|
| CN | 207596984 | U | 7/2018 |
| DE | 1796178 | A1 | 2/1972 |
| DE | 19925373 | A1 | 12/2000 |
| JP | S5167675 | U | 5/1976 |
| JP | S5789495 | A | 6/1982 |
| JP | S60149798 | A | 8/1985 |
| JP | S60147672 | U | 10/1985 |
| JP | S62290876 | A | 12/1987 |
| JP | S637169 | U | 1/1988 |
| JP | H0334064 | U | 4/1991 |
| JP | H11200096 | A | 7/1999 |
| JP | 2000017480 | A | 1/2000 |
| JP | 2001015454 | A | 1/2001 |
| JP | 2001035813 | A | 2/2001 |
| JP | 2003520898 | A | 7/2003 |
| JP | 2004525263 | A | 8/2004 |
| JP | 2006016649 | A | 1/2006 |
| JP | 2003520898 | A5 | 8/2006 |
| JP | 2007119877 | A | 5/2007 |
| JP | 2009084753 | A | 4/2009 |
| JP | 2014189811 | A | 10/2014 |
| TW | I341875 | B | 5/2011 |
| TW | I554652 | B | 10/2016 |
| WO | 02079548 | A1 | 10/2002 |
| WO | 2013057802 | A1 | 4/2015 |

OTHER PUBLICATIONS

English translation KR 20090132090. (Year: 2009).*
English translation JP 2001015454, Mutsubara et al. (Year: 2001).*
English translation CN 204509481, Tian et al. (Year: 2015).*
English translation JP 2006-152377, Kadota et al. (Year: 2006).*

* cited by examiner

FLOW GENERATOR, DEPOSITION DEVICE AND METHOD FOR THE DEPOSITION OF A MATERIAL

BACKGROUND OF THE INVENTION

Field of the Invention

The invention relates to a flow generator, a deposition device and to a method for the deposition of a material on a surface of an object.

The requirements for layer thickness distribution and coating quality of layers deposited in objects are continually rising, above all with respect to the homogeneity that is to be achieved. This applies in particular to galvanically deposited layers on components that are used, for example, in radio or high-frequency technology.

Because high currents are often used in radio and high-frequency technology, the ohmic resistance or the impedance of a component, which depends significantly on the layer thickness, is an important physical parameter of the component. If the component has an inhomogeneous layer thickness, this can have unwanted effects on the electrical properties of the component.

Until now, the flow of electrolyte arriving at objects to be coated has been achieved with distributor pipes, eductors, Venturi nozzles or the like. An incoming flow of this type leads to a chaotic and uncontrollable eddying of the electrolyte in the immediate proximity of the objects. As a result the products have a limited quality. Due to the chaotic incoming flow, small number of contact points and non-directed electric field lines, experience shows that a homogeneous layer thickness distribution cannot be guaranteed.

Summary of the Invention

The present invention is based on the object of providing a flow generator, a deposition device and a method for the deposition of a material by means of which improved layers, in particular more homogeneous layers, can be deposited.

This object is achieved according to the invention by the objects of the independent patent claims.

Preferred developments of the invention are each the object of dependent patent claims. The flow generator according to the invention, or the deposition device according to the invention, can advantageously be employed in the method according to the invention.

The invention enables a more homogeneous incoming flow of electrolyte to an object to be coated. The invention thus makes it possible to meet the rising demands for thickness distribution and coating quality, in particular with respect to the homogeneity that is to be achieved. Better, higher-performance components, in particular semiconductor components or elements, with tighter specifications, can consequently be manufactured with the invention.

The invention is inter alia advantageously applicable to the electrochemical coating (galvanizing) of objects such as, for example, substrates, primarily with copper, although also with nickel, gold, silver and/or tin. The invention can, for example, advantageously be employed for the galvanic or electrochemical deposition onto ceramic substrates for active or passive components, in particular such components as are used in a high-frequency technology and radio-frequency technology, and moreover for deposition onto semiconductors, in particular semiconductor substrates and circuit boards.

The flow generator according to the invention comprises an electrolyte supply apparatus for supplying an electrolyte, as well as an electrolyte distribution apparatus.

In the terms of the invention, an electrolyte refers to a liquid that contains ions that can be moved in a directed manner under the influence of an electric field. In the present invention, the ions are preferably metal ions.

In one preferred form of embodiment of the invention, the electrolyte distribution apparatus comprises at least one first distributor plate.

It is further advantageous if the electrolyte distribution apparatus comprises at least one further distributor plate that is arranged opposite the first distributor plate, downstream in the sense of the direction of the flow of electrolyte. The first and the further distributor plates are advantageously arranged parallel to one another.

Through the use of two distributor plates, a two-stage homogenization of an electrolyte flow can be realized. With the aid of the first distributor plate, a prehomogenization of the electrolyte flow can be achieved. With the aid of the second distributor plate, a fine homogenization of the prehomogenized electrolyte flow can be achieved.

At least one of said distributor plates, in particular each of said distributor plates, can be a plate provided with openings through which electrolyte can flow, preferably a perforated plate.

Additionally or as an alternative to the further distributor plate, the electrolyte distribution apparatus can comprise at least one distributor pipe that is arranged opposite the first distributor plate upstream in the sense of the direction of the flow of electrolyte. This is advantageously connected to the electrolyte supply apparatus of the flow generator.

In the variant embodiment in which the electrolyte distribution apparatus comprises the distributor pipe, the distributor pipe can be used for a prehomogenization of an electrolyte flow. The first distributor plate and the further distributor plate, if present, can in this case be used for a further homogenization of the electrolyte flow that has undergone prehomogenization with the aid of the distributor pipe.

It is moreover preferred if the distributor pipe has outlet openings on its side that faces away from the first distributor plate. The distributor pipe, on the other hand, preferably does not have any outlet openings on its side that faces toward the first distributor plate.

The deposition device according to the invention for the deposition of a material onto a surface of an object comprises a flow generator according to the invention and an object holder.

A preferred use of the deposition device is its use for the galvanic deposition of a metal layer onto an object to be coated.

The object onto which the material should be deposited can advantageously be releasably fastened at the object holder. The object holder can, for example, be designed as a frame provided with an opening to accommodate the object. The dimensions of this opening preferably correspond to the dimensions of the object to be coated.

It is furthermore advantageous if the object holder is arranged parallel to the distributor plate or to the distributor plates of the electrolyte distribution apparatus.

In one preferred form of embodiment of the invention, the flow generator comprises a housing, open on one side, with an outflow opening facing toward the object holder. The housing advantageously forms an "impinging flow box" that serves to guide a flow of electrolyte to the object holder or, if the object to be coated is fastened to the object holder, to the object. A perpendicular incoming flow of the object to be coated with the electrolyte can in particular be achieved with the aid of the housing.

It is further expedient if the housing is connected to the electrolyte supply apparatus, so that the electrolyte can be guided into the housing via the electrolyte supply apparatus. Said electrolyte distribution apparatus is preferably arranged in the housing. A region of the housing that is located downstream of the electrolyte distribution apparatus in the sense of the direction of flow of electrolyte, advantageously forms a flow channel through which an electrolyte flow developed in the housing is guided to the object holder or to the object to be coated.

Preferably the housing is arranged at a distance from the object holder. In this way it can be ensured that a gap is formed between the housing and the object holder, through which, after deflection, the electrolyte flow that is developed in the housing can flow onto a surface of the object to be coated, in particular flow to all sides.

It is advantageous if the distance is at most 2 cm, preferably at most 1.5 cm, particularly preferably at most 1 cm. In this way it is possible to avoid a significant spreading of the electrolyte flow before the electrolyte flow arrives at the object to be coated. A distance with a value of between 3 and 5 mm has been found to be particularly advantageous.

The height and/or width of the outflow opening of the housing is advantageously matched to the height and/or width of the opening of the object holder that is provided to accommodate the object. In this way, the spreading or constriction of the flow lines between the housing and the object holder can be avoided.

It is, for example, preferred if the outflow opening of the housing is dimensioned such that its width corresponds to at least 80%, in particular at least 90%, of the width of the opening of the object holder provided to accommodate the object, and/or that its height corresponds to at least 80%, in particular at least 90%, of the height of the opening of the object holder provided to accommodate the object. It can, moreover, be provided that the outflow opening of the housing is dimensioned such that its width corresponds to at most 120%, in particular at most 110%, of the width of the opening of the object holder provided to accommodate the object, and/or that its height corresponds to at most 120%, in particular at most 110%, of the height of the opening of the object holder provided to accommodate the object. Preferably the width of the outflow opening of the housing is equal to the width of the opening of the object holder provided to accommodate the object, and/or the height of the outflow opening of the housing is equal to the height of the opening of the object holder provided to accommodate the object.

It is furthermore advantageous if the deposition device comprises an anode through which the electrolyte can flow. This can, for example, be arranged between the electrolyte distribution apparatus and the object holder.

The anode can, for example, be designed as a lattice anode, in particular one formed of expanded metal. The anode is preferably arranged in the housing of the flow generator.

The anode is advantageously arranged parallel to the distributor plate or to the distributor plates of the electrolyte distribution apparatus.

It is furthermore advantageous if the height and/or width of the anode is matched to the height and/or width of the opening of the object holder that is provided to accommodate the object. In this way, the spreading or constriction of the electric field lines between the anode and the object holder can be avoided.

It is, for example, preferred if the anode is dimensioned such that its width corresponds to at least 80%, in particular at least 90%, of the width of the opening of the object holder provided to accommodate the object, and/or that its height corresponds to at least 80%, in particular at least 90%, of the height of the opening of the object holder provided to accommodate the object. It can further be provided that the anode is dimensioned such that its width corresponds to at most 120%, in particular at most 110%, of the width of the opening of the object holder provided to accommodate the object, and/or that its height corresponds to at most 120%, in particular at most 110%, of the height of the opening of the object holder provided to accommodate the object. Preferably the width of the anode is equal to the width of the opening of the object holder provided to accommodate the object, and/or the height of the anode is equal to the height of the opening of the object holder provided to accommodate the object.

The anode is preferably an insoluble anode, i.e. an anode that does not dissolve in the electrolyte. Titanium or platinized titanium can, for example, be used here as the anode material. In the event that the anode is an insoluble anode, a supply of metal to the electrolyte can be achieved through subsequent dosing of materials containing metal, such as, for example, copper oxide or Fe2+/Fe3+.

The flow generator can optionally comprise a flow baffle for partially screening an electrolyte flow and/or for partially screening electric field lines originating from the anode. The flow baffle is preferably arranged between the anode and the object holder. The flow baffle makes it possible to compensate for special features of the object layout, in order to achieve a homogeneous layer thickness distribution on the object.

It is furthermore advantageous if the object holder comprises a plurality of contact points for electrically contacting the object, in particular for electrically contacting an edge of the object. Preferably the contact points are arranged distributed equidistantly over an edge of an opening of the object holder provided to accommodate the object. A homogeneous curve of the electric field lines at the object holder or at an object fastened at the object holder can be achieved in this way, which in turn enables a homogeneous exposure of the object to an electrical flow of the ions contained in the electrolyte.

Fundamentally it can be provided that the object holder only has contact points on one of its two sides. Preferably, the object holder is fitted with contact points at each of its two sides. In particular, the same number of contact points can be provided at both sides of the object holder, for example eight contact points on each side.

The deposition device can further comprise an overflow basin with an overflow weir. Preferably the flow generator is arranged in the overflow basin. The overflow basin can be filled with an electrolyte, in particular up to the edge of the overflow weir.

The deposition device can furthermore comprise a drain pipe, in particular a drain pipe provided with holes to drain the electrolyte out of the overflow basin. The drain pipe is advantageously arranged under the object holder. The longitudinal extent of the drain pipe preferably runs in a horizontal direction. It is further preferred if the drain pipe and the object holder are arranged in such a way that they have a common symmetry plane.

With the aid of the overflow basin and of the drain pipe, a homogeneous outflow, in particular homogeneous on every side, of the electrolyte from the object can be realized, which in turn enables a homogeneous subsequent flow of electrolyte directed to the object.

In a preferred development of the invention, it is provided that the deposition device comprises a retention basin in which at least part of the overflow basin is arranged. The retention basin can be used to catch electrolyte emerging from the overflow basin, in order to be able to reuse it.

In addition to the retention basin, the deposition device can comprise a first pump connected to the retention basin for pumping the electrolyte out of the retention basin, as well as for conveying the electrolyte that has been pumped out of the retention basin to the electrolyte supply apparatus of the flow generator.

The deposition device can moreover comprise a second pump connected to the drain pipe for pumping the electrolyte out of the drain pipe, as well as for conveying the electrolyte that has been pumped out of the drain pipe into the retention basin.

Instead of using said second pump for draining the electrolyte out of the drain pipe, an alternative variant embodiment provides that the electrolyte is drained out of the drain pipe with the aid of gravity, without a pump, via a fluid line, and if appropriate leading it into the retention basin. In this case a valve, in particular a regulator valve, can for example be used to adjust the volumetric flow rate of the electrolyte flow being drawn away through the drain pipe.

The deposition device can optionally comprise two drain pipes arranged laterally next to the object holder for draining the electrolyte out of the overflow basin. The longitudinal extent of these two drain pipes preferably runs in a vertical direction. For these two drain pipes, the deposition device can comprise one common pump connected to these two drain pipes, or an individual pipe for each connected to the respective one of these two drain pipes.

The deposition device advantageously comprises a flow sensor for at least one of its pumps, preferably for each of its pumps, for measuring a volumetric flow rate of an electrolyte flow that is flowing through the respective pump.

In a preferred embodiment of the invention, the deposition device comprises a further flow generator that is preferably designed with the same construction as the flow generator mentioned first. The object holder is advantageously arranged between the two flow generators. It is particularly preferred if the two flow generators are arranged with mirror-symmetry with respect to the object holder. Through the use of two flow generators it is possible to coat the object on both sides simultaneously.

The deposition device can, furthermore, comprise at least one voltage source, in particular at least one DC voltage source. The deposition device preferably comprises a separate voltage source for each of its flow generators.

In the method according to the invention for depositing material on a surface of an object, an electrolyte is guided to the surface of the object.

The method according to the invention is advantageously carried out with the aid of the deposition device according to the invention.

The object is preferably a plate-like object, in particular having a rectangular form. It is particularly preferred if the object is aligned vertically during the performance of the method, for example with the aid of the object holder previously explained.

The object can, for example, be or comprise a substrate, in particular a ceramic substrate. Preferably the object is or comprises a substrate with active or passive elements, in particular semiconductor components, arranged thereon. The elements are expediently separated after the deposition.

The material that is to be deposited in the method on said surface of the object can in particular be a metal material. The object can furthermore comprise an electrically conductive base layer, in particular a metal base layer, on which the material is deposited. The base layer can, for example, contain copper, nickel, gold, silver and/or tin.

In one advantageous form of embodiment of the invention, it is provided that a flow of the electrolyte is developed that is directed parallel to or essentially parallel to a surface normal of the surface of the object. Preferably this flow is developed with the aid of the flow generator according to the invention.

The formulation, "parallel to or essentially parallel to a surface normal" in the above paragraph can be understood in particular in the sense of the invention to mean that said flow of the electrolyte is directed at an angle of at most 10°, preferably at most 5°, to the surface normal.

The electrolyte is preferably brought to the surface of the object by means of said flow of the electrolyte.

It is advantageous if said flow of the electrolyte to the surface of the object is diverted and guided away along the surface from the object, preferably parallel or essentially parallel to the surface of the object. The diverted flow is preferably guided away to all sides of the object.

Analogously to the above definition, the formulation, "parallel to or essentially parallel to the surface of the object" in the sense of the invention can in particular be understood to mean that said flow of the electrolyte is directed after the deflection at an angle of at most 10°, preferably at most 5°, to the surface.

It is furthermore advantageous if a part of said flow of the electrolyte is deflected upward and forms a partial flow directed upward, and a further part of said flow of the electrolyte is deflected downward and forms a partial flow directed downward.

The volumetric flow rate of the downwardly directed partial flow is preferably adjusted such that the volumetric flow rate of the downwardly directed partial flow is the same or essentially the same as the volumetric flow rate of the upwardly directed partial flow.

In the sense of the invention, the formulation "the same or essentially the same" can be understood in particular to mean that a difference of at most 10%, preferably of at most 5%, exists between the values when compared with one another.

The volumetric flow rate of the downwardly directed partial flow can, for example, be adjusted with the aid of the previously mentioned first pump, in particular by adjusting the conveying rate of the pump.

It is furthermore advantageous if a part of said flow of the electrolyte is deflected sideways and forms a partial flow directed to the left (when viewing said surface of the object from the front), and a further part of said flow of the electrolyte is deflected sideways and forms a partial flow directed to the right (when viewing said surface of the object from the front).

Preferably the volumetric flow rate of the partial flow that is directed to the left and the volumetric flow rate of the partial flow that is directed to the right is adjusted, in particular with the aid of pumps, in such a way that they are the same or essentially the same as the volumetric flow rate of the upwardly directed partial flow.

In one preferred development of the invention, it is provided that an electrolyte flow directed at the object flows onto the object both at its front side as well as at its rear side. In this way it is possible to ensure that the object is coated on both sides, which is in particular advantageous when the object contains components that are to be coated both on its front side as well as on its rear side.

Advantageously, the volumetric flow rate of the front-side electrolyte flow and the volumetric flow rate of the rear-side electrolyte flow are adjusted in such a way that these two volumetric flow rates are the same or essentially the same. In this way it is possible to ensure that the object is subjected to the same pressure on both sides. In this way it is possible to avoid the possibility that even in the event of high volumetric flow rates, pressure differences between the front and rear sides result in damage, for example a fracture, of the object.

It can furthermore be provided that the front side of the object is subjected to a different electrical current strength than the rear side of the object, for example in that a different voltage is applied between the anode of the first-mentioned flow generator and the object holder from that between the anode of the further flow generator and the object holder. This can in particular be advantageous if the front side and the rear side of the object are designed differently, and therefore also should be coated differently.

Preferably the method is a galvanic coating method in which a layer of metal, in particular a layer of copper, nickel, gold, silver and/or tin is deposited onto the object.

The invention is explained in more detail below with reference to figures. Whenever expedient, elements that are identical or have the same effect are here given the same reference signs. The invention is not restricted to the embodiments illustrated in the figures—this refers also to functional features. The description given so far and the subsequent description of the figures contain numerous features, some of which are summarized as groups in the dependent claims. A person skilled in the art will, however, also consider the features individually and combine them into useful further combinations. These features can in particular be combined, individually and in any appropriate combination, with the flow generator according to the invention and/or the deposition device according to the invention and/or the method according to the invention.

DETAILED DESCRIPTION OF THE INVENTION

Figure 1:
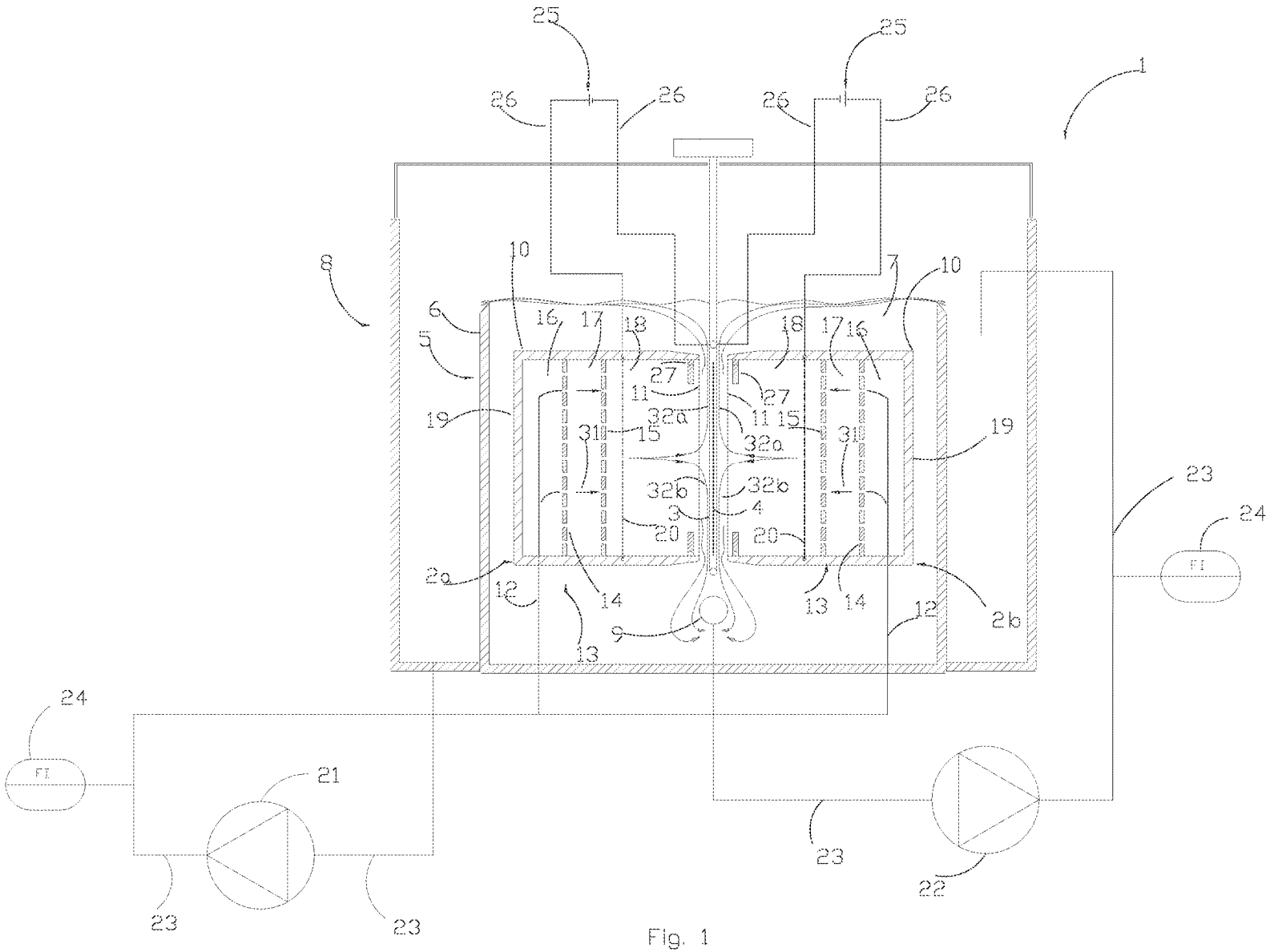
FIG. 1 shows a schematic illustration of deposition device according to a first exemplary embodiment of the invention.

FIG. 1 shows a schematic illustration of a deposition device 1. The deposition device 1 serves for the deposition of a material, in particular for the galvanic deposition of a metal layer on a surface of an object.

The deposition device 1 comprises two flow generators 2*a*, 2*b* with the same design as each other, as well as a vertically suspended object holder 3 at which an object 4 to be coated is releasably fastened. As can be seen from FIG. 1, the two flow generators 2*a*, 2*b* are arranged with mirror symmetry with reference to the object holder 3. For the sake of terminological distinction, the two flow generators 2*a*, 2*b* will sometimes be referred to below as the first flow generator 2*a* and the second flow generator 2*b*.

In the present exemplary embodiment, the object 4 that is to be coated is a substrate, in particular a ceramic substrate, with elements arranged thereon such as, for example, active or passive semiconductor components, and a thin metal base layer surrounding the substrate. The object to be coated has a rectangular shape, and has an edge length of about 200 mm and a thickness between 200 μm and 1000 μm. Said metal base layer (also sometimes known in expert circles as the "seed layer") surrounds the full area of the substrate, including over the substrate edges.

In the present case, the metal base layer is a copper layer, in particular a masked and structured copper layer. The metal base layer is reinforced in a galvanic deposition process with the aid of the deposition device 1. This means that, in the present exemplary embodiment, copper is deposited with the aid of the deposition device 1 onto the existing copper layer, which forms the metal base layer.

It should be obvious that the previously mentioned features of the object 4 are merely to be deemed as exemplary, and that the deposition device 1 is in principle suitable for coating other kinds of object.

In addition to the two flow generators 2*a*, 2*b* the deposition device 1 comprises an overflow basin 5 with an overflow weir 6. Both flow generators 2*a*, 2*b* are arranged in the overflow basin 5. FIG. 1 shows the deposition device 1 in a state in which the overflow basin 5 is filled up to the edge of its overflow weir 6 with an electrolyte 7.

The deposition device 1 further comprises a retention basin 8 in which the overflow basin 5 is arranged. The deposition device 1 further comprises a drain pipe 9 provided with holes whose longitudinal extent runs in a horizontal direction and that is arranged underneath the object holder 3 in such a way that the drain pipe 9 and the object holder 3 have a common symmetry plane.

The two flow generators 2*a*, 2*b* of the deposition device 1 each comprise a housing 10 arranged at a distance from the object holder 3 and open on one side, with an outflow opening 11 that faces toward the object 4 to be coated. The two flow generators 2*a*, 2*b* each also comprise an electrolyte supply apparatus 12 and an electrolyte distribution apparatus 13.

The electrolyte distribution apparatus 13 of the respective flow generator 2*a*, 2*b* comprises a first distributor plate 14 and a further distributor plate 15, wherein the two distributor plates 14, 15 are arranged parallel to one another as well as parallel to the object holder 3, and are implemented as perforated plates with openings through which electrolyte 7 can flow.

As can be seen in FIG. 1, the two distributor plates 14, 15 of the respective flow generators 2*a*, 2*b* are arranged in its housing 10. The two distributor plates 14, 15 of the respective flow generator 2*a*, 2*b* divide its housing 10 into a first chamber 16, a second chamber 17 and a flow channel 18, wherein the first chamber 16 extends from a side wall 19 of the housing 10 that is arranged parallel to the outflow opening 11 to the first distributor plate 14, the second chamber 17 extends from the first distributor plate 14 to the second distributor plate 15, and the flow channel 18 extends from the second distributor plate 15 over the remaining part of the housing 10.

In each of the two housings 10 the deposition device 1 also comprises a lattice anode 20 through which electrolyte 7 can flow, arranged between the electrolyte distribution apparatus 13 of the respective flow generator 2*a*, 2*b* and the object holder 3.

Both the respective anode 20 and the outlet opening 11 of the respective housing 10 are dimensioned such that their width and height correspond approximately to the width and height of the object 4 to be coated. The term "width" relates here to an extent perpendicular to the plane of the drawing of FIG. 1.

The deposition device 1 further comprises a first pump 21 for pumping the electrolyte 7 out of the retention basin 8 and for conveying the electrolyte 7 pumped out of the retention basin 8 to the electrolyte supply apparatus 12 of the respective flow generator 2*a*, 2*b*. The deposition device 1 further comprises a second pump 22 for pumping the electrolyte 7 out of the drain pipe 9, as well as for conveying the electrolyte 7 that has been pumped out of the drain pipe 9 into the retention basin 8. The first pump 21 is connected via a fluid line 23 to the retention basin 8, and via a further fluid line 23 to the electrolyte supply apparatuses 12 of the two flow generators 2*a*, 2*b*, while the second pump 22 is connected via a fluid line 23 to the drain pipe 9 and via a further fluid line 23 to the retention basin 8.

The deposition device 1 further comprises a flow rate sensor 24 for each of its pumps 21, 22 for measuring a volumetric flow rate of an electrolyte flow that is flowing through the respective pump 21, 22.

The deposition device 1 moreover comprises a separate DC voltage source 25 for each of its flow generators 2*a*, 2*b*. The respective DC voltage source 25 is connected, as can be seen in FIG. 1, via electrical cables 26 to the anode 20 arranged in the associated flow generator 2*a*, 2*b* as well as to the object holder 3.

The respective flow generator 2*a*, 2*b* further comprises in its housing 10 a flow baffle 27 that is arranged between the anode 20 arranged in the housing 10 of the respective flow generator 2*a*, 2*b* and the object holder 3, and which serves for partially screening an electrolyte flow and for partially screening electric field lines originating from the anode 20.

Figure 2:
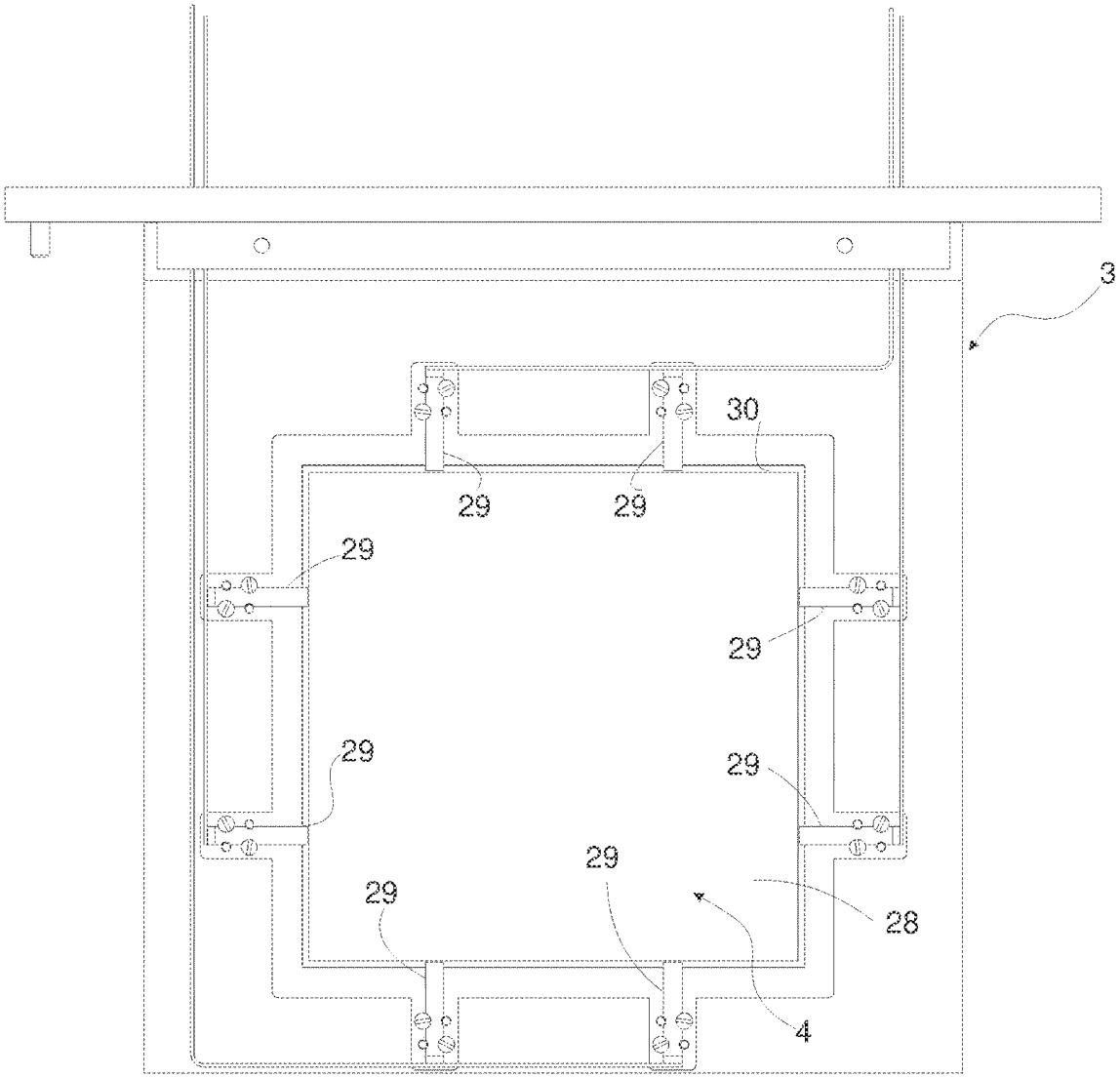
FIG. 2 shows a front view of an object holder of the deposition device and an object to be coated that is fastened releasably to the object holder.

FIG. 2 shows a frontal view of the previously mentioned object holder 3 as well as the object 4 that is to be coated, fastened releasably to the object holder 3.

The object holder 3 is designed as a frame, and has an opening provided to accommodate the object 4, although it is not visible in FIG. 2 since the object 4 that is to be coated is arranged therein.

One side of the object holder 3 (referred to below as the front side of the object holder 3) is visible in FIG. 2, while the other side of the object holder 3 faces away from the observer. Consequently again, only one side (referred to below as the front side of the object 4) of the object 4 that is to be coated and its surface 28 that is to be coated is visible in FIG. 2.

The object holder 3 has a plurality of contact points 29, in the present case eight contact points 29, on its front side for electrically contacting the object 4, and these are in electrical contact with the edge 30 of the object 4 at its front side. On its rear side, not visible in FIG. 2, the object holder 3 has the same number of contact points 29 for electrically contacting the object 3, and these are in electrical contact with the edge 30 of the object 4 at its rear side. The front-side contact points 29 are electrically connected to one of the two DC voltage sources 25, while the rear-side contact points 29 are electrically connected with the other of the two DC voltage sources 25.

Both on the front side and on the rear side of the object holder 3 the contact points 29 are arranged distributed equidistantly over the edge of the opening of the object holder 3 provided to accommodate the object 4, and thus also equidistantly over the edge 30 of the object 4.

The mode of operation of the deposition device 1 is described below with reference to FIG. 1. Since, as previously explained, the two flow generators 2*a*, 2*b* are designed with the same construction as one another, the mode of operation of the deposition device 1 is described, for the sake of simplicity, by way of example with reference to one of the two flow generators 2*a*, 2*b*, or, put more precisely, with reference to the first flow generator 2*a*. The following explanations apply analogously to the second flow generator 2*b*. This means that both flow generators 2*a*, 2*b* are used in order to subject the object 4 to be coated to the flow of electrolyte 7, so that the object 4 is homogeneously coated on both sides.

With the aid of the first pump 21, the electrolyte 7 is introduced via the electrolyte supply apparatus 12 of the first flow generator 2*a* into the housing 10 of the first flow generator 2*a*, or, put more precisely, into the first chamber 16 of the housing 10. An electrolyte flow 31 develops in the first chamber 16, which flows through the first distributor plate 14 and is thus prehomogenized by the first distributor plate 14. The prehomogenized electrolyte flow 31 then flows through the second chamber 17 of the housing 10 as well as the further distributor plate 15, and the electrolyte flow 31 is further homogenized as it flows through the further distributor plate 15. The homogenized electrolyte flow 31 then flows out of the flow channel 18 of the housing 10 via the outflow opening 11 of the housing 10 perpendicularly, or essentially perpendicularly, to the object to be coated 4.

The electrolyte flow 31 is diverted at the surface 28 that is to be coated of the object 4, and guided away from the object 4 parallel, or essentially parallel, to said surface 28. One part of the electrolyte flow 31 is diverted upward, and forms an upwardly directed partial flow 32*a*. A further part of the electrolyte flow 31 is diverted downward, and forms an downwardly directed partial flow 32*b*. Said partial flows 32*a*, 32*b* flow away through a gap between the object holder 3 and the housing 10 of the first flow generator 2*a*.

The volumetric flow rate of the downwardly directed partial flow 32*b* is adjusted such that the volumetric flow rate of the downwardly directed partial flow 32*b* is the same as the volumetric flow rate of the upwardly directed partial flow 32*a*. This can, for example, be achieved in that the conveying rates of the two pumps 21, 22 are adjusted such that the two flow rate sensors 24 measure the same volumetric flow rate.

The downwardly directed partial flow 32*b* flows through the holes of the drain pipe 9 into the drain pipe 9, while the upwardly directed partial flow 32*a* flows out of the overflow basin 5 over the overflow weir 6. The electrolyte 7 is pumped out of the drain pipe 9 with the aid of the second pump 22, and conveyed into the retention basin 8. The electrolyte 7 that is in the retention basin 8 is pumped out of the retention basin 8 with the aid of the first pump 21, and conveyed to the electrolyte supply apparatus 12 of the first flow generator 2*a*.

An electric voltage is present between the anode 20 that is arranged in the housing 10 of the first flow generator 2*a* and the object holder 3. Since the object 4 is in electrical contact with the object holder 3 via the contact points 29, the same voltage is also present between said anode 20 and the object 4. There is consequently an electric field between said anode 20 and the object holder 3, as a result of which ions contained in the electrolyte 7 are guided to the object to be coated 4. Because of the previously described design of the anode 20 and of the object holder 3, this electric field has homogeneous electric field lines, so that the object 4 is subjected to a homogeneous stream of ions.

The description of the following exemplary embodiments is primarily limited to the differences from the preceding exemplary embodiment, to which reference is made in respect of identical features and functions. Features of the preceding exemplary embodiment are adopted into the following exemplary embodiments without being described again.

Figure 3:
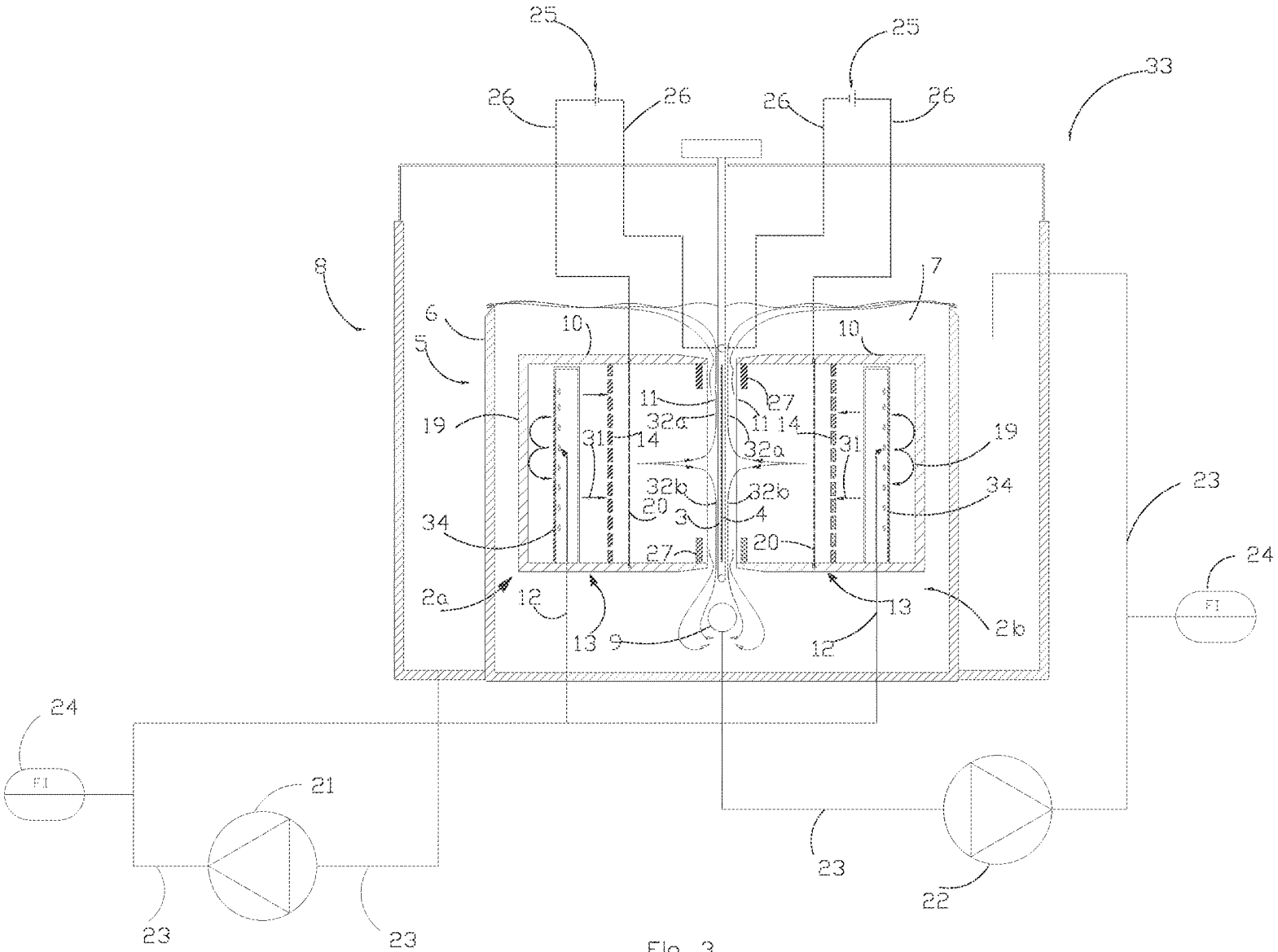
FIG. 3 shows a schematic illustration of a deposition device according to a second exemplary embodiment of the invention.

FIG. 3 shows a schematic illustration of a second deposition device 33 for depositing material, in particular for the galvanic deposition of a metal layer onto a surface of an object.

This deposition device 33 again comprises a first and a second flow generator 2*a*, 2*b*, wherein the two flow generators 2*a*, 2*b* are designed with the same construction as each other.

In the present exemplary embodiment, the electrolyte distribution apparatus 13 of the respective flow generator 2*a*, 2*b* does not comprise two distributor plates, but only a single distributor plate 14. In addition to its distributor plate 14, the electrolyte distribution apparatus 13 of the respective flow generator 2*a*, 2*b* comprises a distributor pipe 34 that is arranged between the distributor plate 14 and the side wall 19 of the housing 10 that is arranged parallel to the outflow opening 11, and has a plurality of outlet openings on its side that faces away from the distributor plate 14, or the side that faces toward the side wall 19. The distributor pipe 34 of the respective flow generator 2*a*, 2*b* is connected to this electrolyte supply apparatus 12.

Since the two flow generators 2*a*, 2*b* of the deposition device 33 are designed with the same construction as one another, the mode of operation of the deposition device 33 is described, for the sake of simplicity, by way of example with reference to one of the two flow generators 2*a*, 2*b* or, put more precisely, with reference to the first flow generator 2*a*. The following explanations apply analogously to the second flow generator 2*b*.

With the aid of the first pump 21 of the deposition device 33, the electrolyte 7 is introduced via the electrolyte supply apparatus 12 of the first flow generator 2*a* into the distributor pipe 34 of the first flow generator 2*a*. The electrolyte 7 emerges from the outlet openings of the distributor pipe 34 from the distributor pipe 34, wherein a prehomogenized electrolyte flow 31 is developed. This prehomogenized electrolyte flow 31 meets the side wall 19 of the housing 10 of the first flow generator 2*a*, is diverted there and flows from the side wall 19 further to the distributor plate 14. The electrolyte flow 31 then flows through the distributor plate 14, and the electrolyte flow 31 is further homogenized as it flows through the distributor plate 14. After the distributor plate 14, the homogenized electrolyte flow 31 then flows via the outflow opening 11 of the housing 10 perpendicularly, or essentially perpendicularly, to the object to be coated 4. In other respects, the mode of operation of the deposition device of FIG. 3 corresponds to that of the deposition device of FIG. 1.

Figure 4:
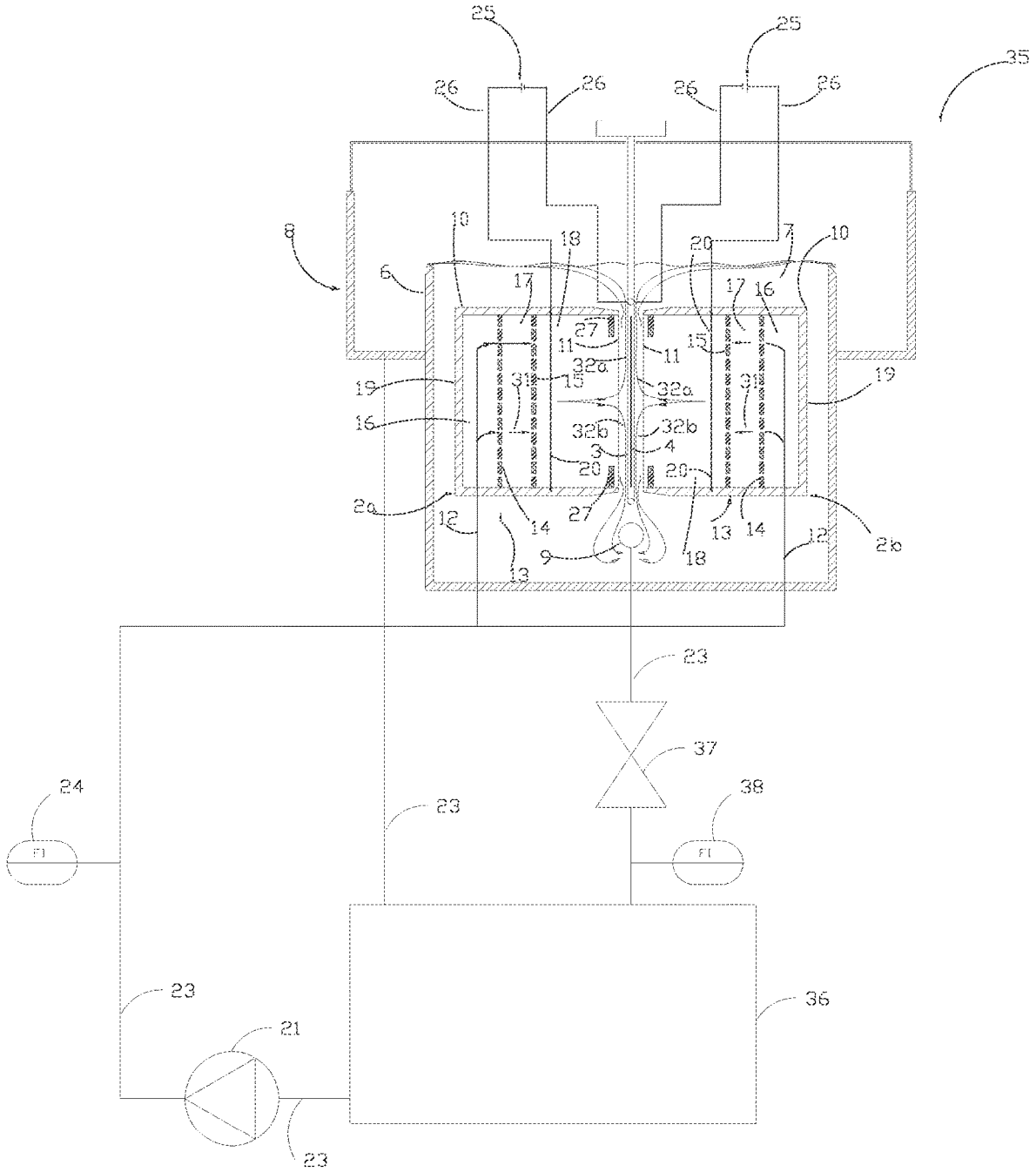
FIG. 4 shows a schematic illustration of a deposition device according to a third exemplary embodiment of the invention.

FIG. 4 shows a schematic illustration of a third deposition device 35 for depositing material, in particular for the galvanic deposition of a metal layer onto a surface of an object.

This deposition device 35 again comprises an overflow basin 5 and a retention basin 8, wherein, in the present exemplary embodiment, only a part of the overflow basin 5, or, put more precisely, only the upper part of the overflow basin 5, is arranged inside the retention basin 8.

The deposition device 35 of FIG. 4 does not comprise two pumps, but only a single pump 21. In addition, the deposition device 35 comprises a reservoir 36 and valve 37.

Said pump 21 is connected on the inlet side via a fluid line 23 to the reservoir 36, and on the outlet side via a further fluid line 23 to the electrolyte supply apparatuses 12 of the two flow generators 2*a*, 2*b*. The reservoir 36 is connected on the inlet side via a fluid line 23 to the retention basin 8, and via a further fluid line 23, to which a flow sensor 38 is connected, to the drain pipe 9.

In the present exemplary embodiment, the electrolyte 7 that is in the retention basin 8, as well as the electrolyte 7 that is in the drain pipe 9, is drawn away from the retention basin 8 and from the drain pipe 9 with the aid of gravity. With the aid of said valve 37, or, put more precisely, through an appropriate adjustment of the valve position, it is possible to ensure that the volumetric flow rate of a partial flow of the electrolyte 7 leaving the overflow basin 5 by way of the drain pipe 9 is the same as the volumetric flow rate of a partial flow of the electrolyte 7 leaving the overflow basin 5 via the overflow weir 6.

Whether the volumetric flow rate of the partial flow leaving the overflow basin 5 by way of the drain pipe 9 is the same as the volumetric flow rate of the partial flow leaving the overflow basin 5 by way of the overflow weir 6 can be established by means of the two flow sensors 24, 38 of the deposition device 35. If the flow sensor 38 that is connected to the fluid line 23 between the reservoir 36 and the drain pipe 9 measures a value that is half as large as the other flow sensor 24 that is connected to the fluid line 23 between the pump 21 and the electrolyte supply apparatuses 12 of the two flow generators 2*a*, 2*b*, then the volumetric flow rate of the partial flow leaving the overflow basin 5 by way of the drain pipe 9 is equal to the volumetric flow rate of the partial flow leaving the overflow basin 5 by way of the overflow weir 6.

The electrolyte 7 is pumped out of the reservoir 36 with the aid of the pump 21 and is conveyed to the electrolyte supply apparatuses 12 of the two flow generators 2*a*, 2*b*.

The invention has been described in detail with reference to the illustrated embodiments. The invention is nevertheless not limited to or by the disclosed examples. Other variations can be derived by the person skilled in the art from these exemplary embodiments without deviating from the thinking underlying the invention.

LIST OF REFERENCE SIGNS

1 Deposition device
2*a* Flow generator
2*b* Flow generator
3 Object holder
4 Object
5 Overflow basin
6 Overflow weir
7 Electrolyte
8 Retention basin
9 Drain pipe
10 Housing
11 Outflow opening
12 Electrolyte supply apparatus
13 Electrolyte distribution apparatus
14 Distributor plate
15 Distributor plate
16 Chamber

17 Chamber
18 Flow channel
19 Side wall
20 Anode
21 Pump
22 Pump
23 Fluid pipe
24 Flow sensor
25 DC voltage source
26 Electrical cable
27 Flow baffle
28 Surface
29 Contact point
30 Edge
31 Electrolyte flow
32*a* Partial flow
32*b* Partial flow
33 Deposition device
34 Distributor pipe
35 Deposition device
36 Reservoir
37 Valve
38 Flow sensor

The invention claimed is:

1. A deposition device for depositing material on a surface of an object, the deposition device comprising:

a flow generator including an electrolyte supply apparatus for supplying an electrolyte, and an electrolyte distribution apparatus, said electrolyte distribution apparatus including at least one first distributor plate and at least one further distributor plate disposed opposite said at least one first distributor plate, said at least one further distributor plate disposed downstream from said at least one first distributor plate in a flow direction of the electrolyte, said at least one first distributor plate and said at least one further distributor plate each provided with openings through which electrolyte is flowable;

an object holder for holding the object;

an overflow basin with an overflow weir, said flow generator configured in said overflow basin; and a drain pipe configured for drawing the electrolyte away from said overflow basin, said drain pipe formed with holes to drain the electrolyte out of said overflow basin, said drain pipe disposed under said object holder.

2. The deposition device according to claim 1, wherein said flow generator comprises a housing that is open on one side, with an outflow opening facing said object holder, wherein said housing is connected to the electrolyte supply apparatus so that the electrolyte can be guided by way of the electrolyte supply apparatus into said housing, and wherein said electrolyte distribution apparatus is arranged in said housing.

3. The deposition device according to claim 2, wherein said housing is arranged at a distance of no more than 2 cm from the object holder.

4. The deposition device according to claim 2, wherein a width of said outflow opening of said housing corresponds to at least 80% of a width of an opening of said object holder provided to accommodate the object, and/or a height of said outflow opening corresponds to at least 80% of a height of the opening of said object holder provided to accommodate the object.

5. The deposition device according to claim 1, further comprising:

an anode through which the electrolyte can flow arranged between said electrolyte distribution apparatus and said object holder;

said anode being dimensioned with a width that corresponds to at least 80% of a width of an opening of the object holder provided to accommodate the object and/or with a height that corresponds to at least 80% of a height of the opening of the object holder provided to accommodate the object.

6. The deposition device according to claim 5, wherein said flow generator comprises a flow baffle arranged between said anode and said object holder for a partial screening of an electrolyte flow and/or for partial screening of electric field lines originating from said anode.

7. The deposition device according to claim 1, further comprising:

a retention basin in which at least a part of said overflow basin is arranged;

a first pump connected to said retention basin for pumping the electrolyte away from said retention basin and for conveying the electrolyte pumped out of said retention basin to said electrolyte supply apparatus of said flow generator and a second pump connected to said drain pipe for pumping the electrolyte out of said drain pipe and for conveying the electrolyte out of said drainpipe into said retention basin.

8. The deposition device according to claim 1, wherein said flow generator is one of two flow generators and said object holder is arranged between said two flow generators.

9. The deposition device according to claim 1, wherein said object holder is formed with an opening configured for accommodating the object, said object holder has an edge defining said opening, said object holder includes a plurality of contact points for electrically contacting the object, and said plurality of contact points is distributed equidistantly over said edge defining said opening.

10. The deposition device according to claim 1, wherein said drain pipe is disposed directly under said object holder.

11. A method for depositing a material onto a surface of an object, the method which comprises:

providing a deposition device for depositing an electrolyte on a surface of an object, the deposition device having:

a flow generator including an electrolyte supply apparatus for supplying the electrolyte, and an electrolyte distribution apparatus, the electrolyte distribution apparatus including at least one first distributor plate and at least one further distributor plate disposed opposite the at least one first distributor plate, the at least one further distributor plate disposed downstream from the at least one first distributor plate in a flow direction of the electrolyte, the at least one first distributor plate and the at least one further distributor plate each provided with openings through which electrolyte is flowable, an object holder for holding the object, an overflow basin with an overflow weir, the flow generator configured in the overflow basin, and a drain pipe configured for drawing the electrolyte away from the overflow basin, the drain pipe formed with holes to drain the electrolyte out of the overflow basin, the drain pipe disposed under the object holder;

bringing the electrolyte to the surface of the object with the deposition device.

12. The method according to claim 11, which comprises developing a flow of the electrolyte that is directed parallel or substantially parallel to a surface normal of the surface of the object.

13. The method according to claim 12, which comprises bringing the electrolyte to the surface of the object by way of the flow of the electrolyte.

14. The method according to claim 12, which comprises diverting the flow and guiding away the flow of the electrolyte along the surface of the object.

15. The method according to claim 12, which comprises diverting a part of the flow of the electrolyte upward to form an upwardly directed partial flow, and diverting a further part of the flow of the electrolyte downward to form a downwardly directed partial flow, and adjusting a volumetric flow rate of the downwardly directed partial flow such that the volumetric flow rate of the downwardly directed partial flow equals, or substantially equals, a volumetric flow rate of the upwardly directed partial flow.

16. The method according to claim 11, wherein an electrolyte flow directed at the object flows onto the object both at a front side and a rear side of the object, and adjusting a volumetric flow rate of a front-side electrolyte flow and of a rear-side electrolyte flow to be substantially equal.

17. The method according to claim 11, wherein the method is a galvanic coating method in which a layer of a metal is deposited onto the object.

* * * * *